US012453365B2

(12) United States Patent
Murray et al.

(10) Patent No.: US 12,453,365 B2
(45) Date of Patent: Oct. 28, 2025

(54) FLAVOR DELIVERY ARTICLE FOR A SMOKING SUBSTITUTE APPARATUS

(71) Applicant: Imperial Tobacco Limited

(72) Inventors: Samantha Murray, Liverpool (GB); Steven Maxwell-Hogg, Liverpool (GB); Ev Stöckel, Liverpool (GB); Chris Lord, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 519 days.

(21) Appl. No.: 17/726,130

(22) Filed: Apr. 21, 2022

(65) Prior Publication Data

US 2022/0240561 A1 Aug. 4, 2022

Related U.S. Application Data

(63) Continuation of application No. PCT/EP2020/079946, filed on Oct. 23, 2020.

(30) Foreign Application Priority Data

Oct. 25, 2019 (EP) ..... 19205461

(51) Int. Cl.

| | |
|---|---|
| ***A24F 40/70*** | (2020.01) |
| ***A24B 15/167*** | (2020.01) |
| ***A24C 5/01*** | (2020.01) |
| ***A24D 1/20*** | (2020.01) |
| ***A24D 3/17*** | (2020.01) |
| ***A24F 40/10*** | (2020.01) |
| ***A24F 40/20*** | (2020.01) |

(Continued)

(52) U.S. Cl.

CPC ..... *A24B 15/167* (2016.11); *A24C 5/01* (2020.01); *A24D 1/20* (2020.01); *A24D 3/17* (2020.01); *A24F 40/10* (2020.01); *A24F 40/20* (2020.01); *A24F 40/30* (2020.01); *A24F 40/42* (2020.01); *A24F 40/70* (2020.01)

(58) Field of Classification Search

CPC ..... A24F 40/10; A24F 40/20; A24F 40/30; A24F 40/42

See application file for complete search history.

(56) References Cited

U.S. PATENT DOCUMENTS 6,325,859 B1 12/2001 De Roos et al.
11,785,979 B2 * 10/2023 Hufnagel ..... A24B 15/283 131/352

(Continued)

FOREIGN PATENT DOCUMENTS

CN 109 363 231 A 2/2019
CN 110 150 725 A 8/2019

(Continued)

OTHER PUBLICATIONS

International Search Report and Written Opinion (PCT/EP2020/079946), dated Feb. 15, 2021, 16 pages.

(Continued)

*Primary Examiner* — Truc T Nguyen

(74) *Attorney, Agent, or Firm* — DUNLAP CODDING, P.C.

(57) ABSTRACT

A smoking substitute apparatus comprising a flavorant delivery article having a granulated composition comprising a flavorant, a binder and a carrier.

14 Claims, 2 Drawing Sheets

(51) Int. Cl.
*A24F 40/30* (2020.01)
*A24F 40/42* (2020.01)

(56) References Cited

U.S. PATENT DOCUMENTS

2012/0073590 A1* 3/2012 Kawata ..... A24B 13/00 131/352
2012/0103353 A1* 5/2012 Sebastian ..... A24B 13/00 131/352
2012/0298124 A1* 11/2012 Shikata ..... A24B 13/00 131/352
2013/0160779 A1* 6/2013 Chida ..... A24F 42/60 131/355
2014/0020692 A1* 1/2014 Kawata ..... A24B 15/14 131/118
2016/0073695 A1* 3/2016 Sears ..... H05B 3/46 131/329
2017/0065000 A1 3/2017 Sears et al.
2017/0157106 A1 6/2017 Rogers et al.
2017/0347717 A1* 12/2017 Matsumoto ..... H05B 1/0244
2018/0014576 A1* 1/2018 White ..... A61M 11/048
2018/0368472 A1 12/2018 Mishra et al.
2020/0093181 A1* 3/2020 Hubbard ..... A24B 15/403

FOREIGN PATENT DOCUMENTS

DE 20 2019 103342 U1 6/2019
GB 2 561 266 A 10/2018
WO WO 2006/048774 A1 5/2006
WO WO 2016/156493 A2 10/2016
WO WO 2018/050717 A1 3/2018
WO WO 2019/073225 A1 4/2019

OTHER PUBLICATIONS

European Search Report (19205461.7-1105), dated May 6, 2020, 11 pages.

* cited by examiner

FLAVOR DELIVERY ARTICLE FOR A SMOKING SUBSTITUTE APPARATUS

CROSS-REFERENCE TO RELATED APPLICATIONS/INCORPORATION BY REFERENCE STATEMENT

This application is a non-provisional application claiming benefit to the international application no. PCT/EP2020/079946 filed on Oct. 23, 2020, which claims priority to EP 19205461.7 filed on Oct. 25, 2019. The entire contents of each of the above-referenced applications are hereby incorporated herein by reference in their entirety.

FIELD OF THE DISCLOSURE

The present disclosure relates to a flavor delivery article for use with a smoking substitute apparatus and, in particular, a flavor delivery article that is able to deliver flavor to a user during use of a smoking substitute apparatus.

BACKGROUND

The smoking of tobacco is generally considered to expose a smoker to potentially harmful substances. It is generally thought that a significant amount of the potentially harmful substances are generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute systems in order to avoid the smoking of tobacco.

Such smoking substitute systems can form part of nicotine replacement therapies aimed at people who wish to stop smoking and overcome a dependence on nicotine.

Smoking substitute systems include electronic systems that permit a user to simulate the act of smoking by producing an aerosol (also referred to as a "vapor") that is drawn into the lungs through the mouth (inhaled) and then exhaled. The inhaled aerosol typically bears nicotine and/or a flavorant without, or with fewer of, the odor and health risks associated with traditional smoking.

In general, smoking substitute systems are intended to provide a substitute for the rituals of smoking, whilst providing the user with a similar experience and satisfaction to those experienced with traditional smoking and with combustible tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. There are a number of different categories of smoking substitute systems, each utilizing a different smoking substitute approach.

One approach is the so-called "vaping" approach, in which a vaporizable liquid, typically referred to (and referred to herein) as "e-liquid", is heated by a heating device (referred to herein as an electronic cigarette or "e-cigarette" device) to produce an aerosol vapor which is inhaled by a user. The e-liquid typically includes a base liquid as well as nicotine and/or a flavorant. The resulting vapor therefore also typically contains nicotine and/or a flavorant. The base liquid may include propylene glycol and/or vegetable glycerin.

A typical e-cigarette device includes a mouthpiece, a power source (typically a battery), a tank for containing e-liquid, as well as a heating device. In use, electrical energy is supplied from the power source to the heating device, which heats the e-liquid to produce an aerosol (or "vapor") which is inhaled by a user through the mouthpiece.

E-cigarettes can be configured in a variety of ways. For example, there are "closed system" vaping smoking substitute systems, which typically have a sealed tank and heating element. The tank is pre-filled with e-liquid and is not intended to be refilled by an end user. One subset of closed system vaping smoking substitute systems include a main body which includes the power source, wherein the main body is configured to be physically and electrically coupled to a consumable including the tank and the heating element. In this way, when the tank of a consumable has been emptied, that consumable is disposed of. The main body can be reused by connecting it to a new, replacement, consumable. Another subset of closed system vaping smoking substitute systems are completely disposable, and intended for one-use only.

There are also "open system" vaping smoking substitute systems which typically have a tank that is configured to be refilled by a user. In this way the entire device can be used multiple times.

An example vaping smoking substitute system is the myblu™ e-cigarette. The myblu™ e-cigarette is a closed system which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a heater, which for this device is a heating filament coiled around a portion of a wick. The wick is partially immersed in the e-liquid, and conveys e-liquid from the tank to the heating filament. The device is activated when a microprocessor on board the main body detects a user inhaling through the mouthpiece. When the device is activated, electrical energy is supplied from the power source to the heating device, which heats e-liquid from the tank to produce a vapor which is inhaled by a user through the mouthpiece.

An alternative to the "vaping" approach is the so-called Heated Tobacco ("HT") approach in which tobacco (rather than an e-liquid) is heated or warmed to release vapor. HT is also known as "heat not burn" ("HNB"). The tobacco may be leaf tobacco or reconstituted tobacco. In the HT approach the intention is that the tobacco is heated but not burned, i.e., the tobacco does not undergo combustion.

The heating, as opposed to burning, of the tobacco material is believed to cause fewer, or smaller quantities, of the more harmful compounds ordinarily produced during smoking. Consequently, the HT approach may reduce the odor and/or health risks that can arise through the burning, combustion and pyrolytic degradation of tobacco.

A typical HT smoking substitute system may include a device and a consumable. The consumable may include the tobacco material. The device and consumable may be configured to be physically coupled together. In use, heat may be imparted to the tobacco material by a heating element of the device, wherein airflow through the tobacco material causes components in the tobacco material to be released as vapor. A vapor may also be formed from a carrier in the tobacco material (this carrier may for example include propylene glycol and/or vegetable glycerin) and additionally volatile compounds released from the tobacco. The released vapor may be entrained in the airflow drawn through the tobacco.

As the vapor passes through the consumable (entrained in the airflow) from the location of vaporization to an outlet of the consumable (e.g., a mouthpiece), the vapor cools and condenses to form an aerosol for inhalation by the user. The aerosol may contain nicotine and/or flavor compounds.

For a smoking substitute apparatus, it is desirable to deliver nicotine into the user's lungs, where it can be absorbed into the bloodstream. As explained above, in the so-called "vaping" approach, e-liquid is heated by a heating device to produce an aerosol vapor which is inhaled by a user. Many e-cigarettes also deliver flavor to the user to enhance the experience. In such e-cigarettes, e-liquid is often sold as a flavored product, e.g., a specific blend of flavor compounds are already homogeneously mixed with the e-liquid during the manufacturing process. As such, the user would have to purchase flavored consumables that are available on the market, with limited opportunities to personalize the vaping experience according to their preferences. In addition, the flavor compounds that are contained in the e-liquid that is heated to form a flavored aerosol. However, toxicology restrictions are placed on the amount of flavor that can be contained in the e-liquid, and this can result in some e-liquid flavors delivering a weak and underwhelming taste sensation to consumers in the pursuit of safety. Further, there is a view that providing a flavorant as part of the e-liquid, such that the flavorant is vaporized with the e-liquid, may be disadvantageous.

There may be a need for improved design of smoking substitute systems, in particular in regards to the delivery of flavor to a user.

The present disclosure has been devised in the light of the above considerations.

SUMMARY OF THE DISCLOSURE

At its most general, the present disclosure relates to a flavor delivery article that releases a flavorant in the presence of an aerosol generated from a smoking substitution apparatus. This may allow the flavorant to be released when the user puffs on the smoking substitute apparatus. Therefore, this may allow a user to personalize and/or improve the vaping experience, without needing to add a flavorant to an aerosol former. In this way, the flavorant is positioned away from the heater that is used to form the aerosol thereby minimizing or preventing heat-induced decomposition of the flavorant to potentially harmful compounds.

According to a first aspect there is provided a smoking substitute apparatus comprising a flavorant delivery article having a granulated composition comprising a flavorant, a binder and a carrier.

A granulated composition comprises a plurality of particles formed of at least a flavorant, a binder and a carrier. Typically, the binder serves to hold the carrier particles together to form agglomerates containing the flavorant. Each of the particles has a substantially uniform composition throughout. This means that the composition at any given point in a particle is substantially the same. This does not include particles that have distinct regions or substructures, such as particles having core/shell structures where the core and shell compositions are substantially different.

According to a second aspect there is provided a smoking substitute apparatus comprising a flavorant delivery article having granules that comprise a flavorant, a binder and a carrier, wherein each of the granules has a substantially uniform composition throughout.

This means that at any given point in a granule the physical composition is substantially the same. This does not include granules that have distinct regions or substructures, such as granules having core/shell-type structures where the core (inner) and shell (outer) compositions are substantially different in composition and/or concentration.

When there is no flavorant present in the e-liquid, or an amount of flavorant is present which delivers a weak and underwhelming taste sensation to consumers, it is desirable to supplement this with flavorant from another source. The present flavorant delivery article provides an alternative flavorant reservoir that can be used instead of, or in combination with, the e-liquid. Furthermore, use of a granulated composition or granules minimizes segregation, dust, improves flowability and provides uniform distribution of excipients.

Throughout this application, the term "flavorant" is used to describe a compound or combination of compounds that provide flavor and/or aroma. For example, the flavorant may be configured to interact with a sensory receptor of a user (such as an olfactory or taste receptor). The flavorant may include one or more volatile substances. The flavorant may be provided in solid or liquid form. The flavorant may be natural or synthetic. For example, the flavorant may include menthol, licorice, chocolate, fruit flavor (including, e.g., citrus, cherry etc.), vanilla, spice (e.g., ginger, cinnamon) and tobacco flavor. The flavorant may be one or more of supercool menthol, green apple and blueberry mint.

Throughout this application, the term "carrier" is used to describe is used to describe a compound or combination of compounds on which the flavorant is carried. The carrier may be selected from one or more of hydroxylpropyl methylcellulose (HPMC), rich starch, wheat starch, potato starch, microcrystalline cellulose (MCC), bamboo fibers, wheat fibers and oat fibers. In the present disclosure, HPMC generated consistent granules when liquid binder was granule growth. Starches, such as rice and wheat, required less liquid binder in comparison to the HPMC. Excessive liquid binder with starches results in a homogenous gum like material. Therefore, less binder must be used which in turn has financial and environmental benefits.

Throughout this application, the term "binder" is used to describe a compound or combination of compounds that is used to agglomerate a mixture of the flavorant and the carrier. The binder assists the agglomeration process and determines, among other things, the strength of the resulting granules. The binder may be, for example, one or more of a wax, a starch, a polymer, a latex, and a plastic. The binder can be a suitable binding agent (e.g., food grade type binding agent), and exemplary binding agents can be selected from a variety of pectins, gelatins, alginates (e.g., sodium alginate) or starches. The binder may be one or more of pullulan, polyvinyl pyrrolidine (PVP), polyvinyl alcohol (PVOH), agar and gelatin.

In some cases, the flavorant delivery article is positioned in an airflow channel upstream from a mouth end such that, when in use, flavorant is transferred to a flow (e.g., of an aerosol) through the airflow channel. The flavorant delivery article may be positioned to occupy an entire cross section of the airflow channel (i.e., eclipsing the channel) or to occupy part of the cross section of the airflow channel (i.e., partially eclipsing the channel at one or more points). It may be that the relevant part of the smoking substitute apparatus can be opened or disassembled, such as by unscrewing or unclipping, to insert and/or remove flavorant delivery articles from their predetermined position in the airflow channel. Alternatively, it may be that the flavor delivery article can be inserted and removed from its position in the airflow channel via a dedicated slot or other opening.

In some instances, the flavorant delivery article is provided as the granulated composition or granules in an aerosol-permeable container. The container may be a pouch. The container may be of a non-woven fabric. The container may be a non-woven fabric pouch. The advantage of sealing the granulated composition or granules inside such a container, especially where the container is a non-woven fabric pouch, is to safely conceal the granulated composition or granules from spillage to prevent contamination of the user or surroundings. It also retains the particles or granules in close proximity to one another for maximum concentrated effect. Furthermore, if positioned in the airflow channel of a smoking substitute apparatus, the granules are safely held in position during inhalation (so the granules themselves are not inhaled) while also allowing a flow (e.g., of an aerosol) through and/or over the granulated composition or granules to extract and deliver the flavorant directly to the user.

In some embodiments, the flavorant delivery article is provided as the granulated composition or granules in an aerosol-permeable container, wherein the aerosol-permeable container comprises or consists of a pouch. In some embodiments, the flavorant delivery article is provided as the granulated composition or granules in an aerosol-permeable container, wherein the aerosol-permeable container comprises or consists of a pouch and wherein the pouch comprises non-woven fabric.

In some embodiments, the pouch comprises or consists of plant-based materials. In some embodiments, the pouch comprises or consists of one or more materials selected from cellulose (i.e., fibers made with ethers or esters of cellulose, which can be obtained from the bark, wood or leaves of plants, or from other plant-based material), cotton (for example, organic cotton or cotton obtained from non-GMO plants), bio film from wood pulp, abaca (made from a species of banana plant), starch (for example corn starch) and soilon (a combination of polylactic acid and plant starch). In this way, the sustainability of the flavorant delivery article is improved since these materials are obtained from plant matter and are more easily biodegradable or recycled. In some embodiments, the pouch is a non-woven pouch comprising or consisting of plant-based materials, for example one or more of the materials mentioned above.

Existing non-woven pouches, including those which contain plant-based material, often contain plastics such as polypropylene in order to facilitate thermal sealing. The pouch is subjected to heat, which softens the polypropylene within the material allowing it to flow and form a bond to seal the pouch. This causes problems due to the lack of recyclability, reducing the sustainability of the product.

Thus, in some embodiments, the pouch containing the granulated composition or granules does not contain polypropylene. In some embodiments, the pouch containing the granulated composition or granules does not contain any plastics material. In such embodiments, a seal may instead be achieved by alternative sealing methods which do not require the presence of plastics material within the pouch.

In some embodiments, the pouch is sealed using ultrasound. In such sealing methods, heat is generated by vibrating the bag material using a precise sonic frequency. In an ultrasonic weld, the mechanical vibrations applied between two sealing surfaces create frictional heat which melts the surfaces, which are then compressed into a welded seal.

In some embodiments, the pouch is sealed using hydroentanglement. In such sealing methods, a row or multiple rows of highly pressurized, fine, closely spaced water jets impinge on a fiber web which is supported by forming wires. Due to the impact of water jets, fibers from the surface are inserted into the fibrous web, and fibers are displaced and rotated around other fibers that surround them, resulting in fibers twisting and entangling around the neighboring fibers. The fabric produced is held together by the fiber-to-fiber friction.

In some embodiments, the pouch is sealed using needle punching. This is a non-woven sealing process by which the fibers of the pouch are mechanically entangled to produce a non-woven fabric by repeated penetration of barbed needles through a preformed dry fibrous web.

Thus, in some embodiments, the pouch may be selected from an ultrasonically sealed pouch, a hydroentanglement sealed pouch, and a needle punch sealed pouch.

In some embodiments, the pouch is adapted to provide a sustained release of flavor from the pouch. In this way, the user experience may be improved by imparting the aerosol with a more consistent level of flavor for a longer period. In some embodiments, the pore structure of the pouch provides the sustained release. For example, in some embodiments the pouch comprises pores of a reduced average diameter to restrict the release of flavor from the pouch and provide sustained flavor release.

In some embodiments, the fabric of the pouch comprises one or more of flavor compounds and flavor granules embedded or impregnated within the fabric. In other words, in addition to or as an alternative to the interior "pocket" of the pouch containing "loose" flavorant in the form of a granulated composition or granules described above, the fabric forming the pouch may it self comprise embedded or impregnated flavorant in the form of granules or flavorant compounds, immobilized within the fabric matrix which forms the pouch material. This provides an enhanced user experience by, for example, imparting the aerosol with a more intense flavor profile, or providing an initial high level of flavor from the flavorant within the pouch fabric followed by a long-lasting sustained release of flavor from the granulated composition or granules held within the pouch itself.

A further aspect of the disclosure is a method of manufacturing a flavorant delivery article for use in a smoking substitute device, the flavorant delivery article comprising a granulated composition or granules sealed within a pouch, the method comprising:

introducing the granulated composition or granules into the pouch, and sealing the pouch using a procedure selected from ultrasonic sealing, hydroentanglement and needle punching;

wherein the granulated composition or granules comprise a flavorant, optionally a binder and optionally a carrier.

A further aspect of the disclosure is a method of manufacturing a flavorant delivery article for use in a smoking substitute device, the flavorant delivery article comprising a granulated composition or granules sealed within a pouch, the method comprising:

impregnating a non-woven fabric with flavorant;

forming the non-woven fabric into a pouch comprising an opening;

introducing the granulated composition or granules into the opening of the pouch; and sealing the pouch;

wherein the granulated composition or granules comprise a flavorant, optionally a binder and optionally a carrier.

The impregnating of the non-woven fabric with flavorant may comprise contacting the non-woven pouch with one or more flavorant compounds, or contacting the fabric with granules comprising a flavorant such that the granules become embedded within the fabric.

In some cases, the aerosol-permeable container is formed as two aerosol-permeable filters positioned in the airflow channel either side of the granulated composition or granules. The granulated composition or granules are thereby sandwiched between the two filters and held upstream of a mouth end. A wall of the airflow channel therefore acts as part of the container; although the wall is not an aerosol-permeable part of the container.

In some instances, the smoking substitute apparatus has a reservoir that contains a flavorless e-liquid. The e-liquid may consist of a base liquid and optionally nicotine. That is, the e-liquid may not contain any flavorant and may consist solely of a base liquid of propylene glycol and/or vegetable glycerin and/or nicotine.

In some cases, the smoking substitute apparatus does not comprise a flavorant other than as part of the granulated composition or granules.

In some instances, the mean average particle size of the granulated composition or granule size of the granules is up to 5 mm or from 0.1 mm to 4 mm, such as 0.5 mm to 3 mm, 0.75 mm to 2 mm or 1 mm to 1.5 mm. Different mean average particles sizes can be obtained by modifying several parameters of the manufacturing process.

In some cases, the granulated composition or each of the granules comprises a disintegrant. The granulated composition or granules comprise up to 5 wt % of the disintegrant, such as up to 3 wt %, 2 wt % or 1 wt %. The granulated composition or granules may comprise at least 0.1 wt %, 0.2 wt %, 0.5 wt %, 1 wt % or 2 wt % of the disintegrant by mass. Such amounts of the disintegrant help to provide the desired disintegrating effect at the appropriate time without interfering with the other excipients.

Throughout this application, the term "disintegrant" is used to describe a compound or combination of compounds used to allow or promote release of the excipients, such as the flavorant, when contacted with moisture. The disintegrant may, for example, be selected from one or more of a starch, pregelatinized starch, modified starch, microcrystalline cellulose, alginic acid, sodium alginate, an ion-exchange resin.

In some instances, the granulated composition or granules comprise up to 20 wt % of the flavorant, such as up to 15 wt %, 10 wt % or 5 wt %. The granulated composition or granules may comprise at least 1 wt %, 2 wt %, 5 wt %, 10 wt % or 15 wt % of the flavorant by mass. Such amounts of the flavorant help to provide a sustained and detectable flavor to the user.

In some cases, the smoking substitute apparatus is an aerosol delivery apparatus. An aerosol delivery apparatus may itself comprise an aerosol-generator or it may be configured to co-operate with a corresponding apparatus having an aerosol-generator to deliver an aerosol.

According to a third aspect of the disclosure, there is provided a method of manufacturing a flavorant delivery article for a smoking substitute apparatus, comprising a step of granulating a carrier, a flavorant and a binder to form granules, wherein each of the granules has a substantially uniform composition throughout.

Granulation is the process of forming grains or granules from a powdery or solid substance, thereby producing a granular material or granular composition. The granulation involved in the present process utilizes a carrier, binder and flavor. In some cases, a disintegrant is added to ensure flavor release when in contact with moisture. Granulation provides uniform distribution of the excipient and thus allows for the flavorant to be distributed consistently throughout each granule.

In some instances, the flavorant is added to the carrier to form a mixture to which the binder is subsequently added. This allows the carrier and flavorant to mix evenly before adding the binder to start the granule formation process. This helps to ensure consistent distribution of the components throughout each of the granules.

In some cases, the flavorant is added dropwise to the carrier while stirring. This further ensures even distribution of the flavor and carrier mix.

In some instances, there is a step of placing the resulting granules in an aerosol-permeable container. The aerosol-permeable container may be as already described for other aspects of the disclosure.

In some cases, there is a step of placing the aerosol-permeable container into an airflow channel of the smoking substitute apparatus in a position upstream from a mouth end such that, when in use, the flavorant in the granulated composition of granules is entrained in the flow through the airflow channel.

In some cases, the method is a wet granulation method. In such a method, when the liquid binder initially contacts the powder bed (carrier), granule nuclei are formed. Agitation with an impeller in high shear wet granulation then allows the nuclei to grow through coalescence and then consolidate. Granule formation is a three stage process comprising nucleation, transition and ball growth.

Nucleation occurs when binder is introduced into the powder bed of carrier. Upon introduction there is particle-particle interaction. Adhesion occurs due to liquid bridges created by the binder being introduced. The particle-particle interaction is initially viewed as pendular and as more liquid binder is used up the interaction transitions into a capillary type interaction. This is followed by growth of the granules in the transition phase. Growth of the granules is achieved by pendular bridges for one particle or with the combination of two or more granule nuclei. At the transition stage it is not uncommon for the granules to have a wide size distribution. The next stage is ball growth in which larger more spherical granules are produced. Particle size increases with granulation time. The three mechanisms for ball growth are coalescence, breakage and abrasion.

The general procedure for wetting and nucleation is droplet impact followed by penetration followed by formation of initial granule nuclei. Nuclei formation is dependent on the formation properties whilst binder dispersion is dependent on the process parameters. In order to promote distribution of the liquid binder throughout the powder bed, the liquid must sufficiently wet the powder during the liquid spray process.

Factors affecting the granulation process and result include; wettability of the powdered carrier, dimensionless spray rate, drop penetration time, powder properties, thermodynamics, contact angle between liquid and solid components and spreading coefficients.

According to a fourth aspect of the disclosure, there is provided a method of delivering flavor to a user of a smoking substitute apparatus, the method comprising: the user inhaling an aerosol generated by a smoking substitute apparatus according to the first or second aspects of the disclosure; wherein the flavor delivery article is positioned to be perceptible to the user during inhalation. This may be achieved by adherence of the flavor delivery article on the inside and/or outside of the smoking substitute apparatus at a distance such that the user olfactorily perceives the flavor while inhaling from the smoking substitute apparatus. In particular, the flavor delivery article may be positioned in an airflow channel of the smoking substitute apparatus so that the flavorant is entrained in aerosol that is drawn through the airflow channel during inhalation.

According to a fifth aspect of the disclosure, there is provided use of a flavorant delivery article in a smoking substitute apparatus, wherein the flavorant delivery article is as defined in the first or second aspects of the disclosure.

The smoking substitute apparatus may be in the form of a consumable. The consumable may be configured for engagement with a main body (i.e., so as to form a closed smoking substitute system). For example, the consumable may comprise components of the system that are disposable, and the main body may comprise non-disposable or non-consumable components (e.g., power supply, controller, sensor, etc.) that facilitate the delivery of an aerosol by the consumable. In such an embodiment, the aerosol former (e.g., e-liquid) may be replenished by replacing a used consumable with an unused consumable.

Alternatively, the smoking substitute apparatus may be a non-consumable apparatus (e.g., that is in the form of an open smoking substitute system). In such embodiments an aerosol former (e.g., e-liquid) of the system may be replenished by re-filling, e.g., a reservoir of the smoking substitute apparatus with the aerosol former (rather than replacing a consumable component of the apparatus).

In light of this, it should be appreciated that some of the features described herein as being part of the smoking substitute apparatus may alternatively form part of a main body for engagement with the smoking substitute apparatus (i.e., when the smoking substitute apparatus is in the form of a consumable).

Where the smoking substitute apparatus is in the form of a consumable, the main body and the consumable may be configured to be physically coupled together. For example, the consumable may be at least partially received in a recess of the main body, such that there is an interference fit between the main body and the consumable. Alternatively, the main body and the consumable may be physically coupled together by screwing one onto the other, or through a bayonet fitting.

Thus, the smoking substitute apparatus may comprise one or more engagement portions for engaging with a main body. In this way, one end of the smoking substitute apparatus may be coupled with the main body, whilst an opposing end of the smoking substitute apparatus may define a mouthpiece of the smoking substitute system.

Other Features of the Smoking Substitute Apparatus

The above description relates primarily of features of the present disclosure which relate in some manner to the delivery of flavorant to a user. The optional features set out below are applicable to aspects of the disclosure discussed above.

The smoking substitute apparatus may comprise a reservoir configured to store an aerosol former, such as an e-liquid. The e-liquid may, for example, comprise a base liquid and, e.g., nicotine. The base liquid may include propylene glycol and/or vegetable glycerin. The e-liquid may be flavorless. That is, the e-liquid may not contain any flavorant and may consist solely of a base liquid of propylene glycol and/or vegetable glycerin and/or nicotine.

The reservoir may be in the form of a tank. At least a portion of the tank may be translucent. For example, the tank may comprise a window to allow a user to visually assess the quantity of e-liquid in the tank. A housing of the smoking substitute apparatus may comprise a corresponding aperture (or slot) or window that may be aligned with a translucent portion (e.g., window) of the tank. The reservoir may be referred to as a "clearomizer" if it includes a window, or a "cartomizer" if it does not.

The smoking substitute apparatus may comprise a passage for fluid flow therethrough. The passage may extend through (at least a portion of) the smoking substitute apparatus, between openings that may define an inlet and an outlet of the passage. The outlet may be at a mouthpiece of the smoking substitute apparatus. In this respect, a user may draw fluid (e.g., air) into and through the passage by inhaling at the outlet (i.e., using the mouthpiece). The passage may be at least partially defined by the tank. The tank may substantially (or fully) define the passage. In this respect, the tank may surround the passage.

The smoking substitute apparatus may be an electronic smoking substitute apparatus. The smoking substitute apparatus may comprise an aerosol-generator. The aerosol generator may comprise a wick. The aerosol generator may further comprise a heater. The wick may comprise a porous material. A portion of the wick may be exposed to fluid flow in the passage. The wick may also comprise one or more portions in contact with liquid stored in the reservoir. For example, opposing ends of the wick may protrude into the reservoir and a central portion (between the ends) may extend across the passage so as to be exposed to fluid flow in the passage. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid flowing through the passage. This vapor may subsequently cool to form an aerosol in the passage.

The smoking substitute apparatus (or main body engaged with the smoking substitute apparatus) may comprise a power source. The power source may be electrically connected (or connectable) to a heater of the smoking substitute apparatus (e.g., when engaged with the main body). The power source may be a battery (e.g., a rechargeable battery). A connector in the form of, e.g., a USB port may be provided for recharging this battery.

When the smoking substitute apparatus is in the form of a consumable, the smoking substitute apparatus may comprise an electrical interface for interfacing with a corresponding electrical interface of the main body. One or both of the electrical interfaces may include one or more electrical contacts. Thus, when the main body is engaged with the consumable, the electrical interface may be configured to transfer electrical power from the power source to a heater of the consumable.

The electrical interface may also be used to identify the smoking substitute apparatus (in the form of a consumable) from a list of known types. For example, the consumable may have a certain concentration of nicotine and the electrical interface may be used to identify this. The electrical interface may additionally or alternatively be used to identify when a consumable is connected to the main body.

Again, where the smoking substitute apparatus is in the form of a consumable, the main body may comprise an interface, which may, for example, be in the form of an RFID reader, a barcode or QR code reader. This interface may be able to identify a characteristic (e.g., a type) of a consumable engaged with the main body. In this respect, the consumable may include any one or more of an RFID chip, a barcode or QR code, or memory within which is an identifier and which can be interrogated via the interface.

The smoking substitute apparatus or main body may comprise a controller, which may include a microprocessor. The controller may be configured to control the supply of power from the power source to the heater of the smoking substitute apparatus (e.g., via the electrical contacts). A memory may be provided and may be operatively connected to the controller. The memory may include non-volatile memory. The memory may include instructions which, when implemented, cause the controller to perform certain tasks or steps of a method.

The main body or smoking substitute apparatus may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

A puff sensor may be provided that is configured to detect a puff (i.e., inhalation from a user). The puff sensor may be operatively connected to the controller so as to be able to provide a signal to the controller that is indicative of a puff state (i.e., puffing or not puffing). The puff sensor may, for example, be in the form of a pressure sensor or an acoustic sensor. That is, the controller may control power supply to the heater of the consumable in response to a puff detection by the sensor. The control may be in the form of activation of the heater in response to a detected puff. That is, the smoking substitute apparatus may be configured to be activated when a puff is detected by the puff sensor. When the smoking substitute apparatus is in the form of a consumable, the puff sensor may form part of the consumable or the main body.

The disclosure includes the combination of the aspects and preferred features described except where such a combination is clearly impermissible or expressly avoided.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION OF THE DISCLOSURE

Aspects and embodiments of the present disclosure will now be discussed with reference to the accompanying figures. Further aspects and embodiments will be apparent to those skilled in the art. All documents mentioned in this text are incorporated herein by reference.

Figure 1C:
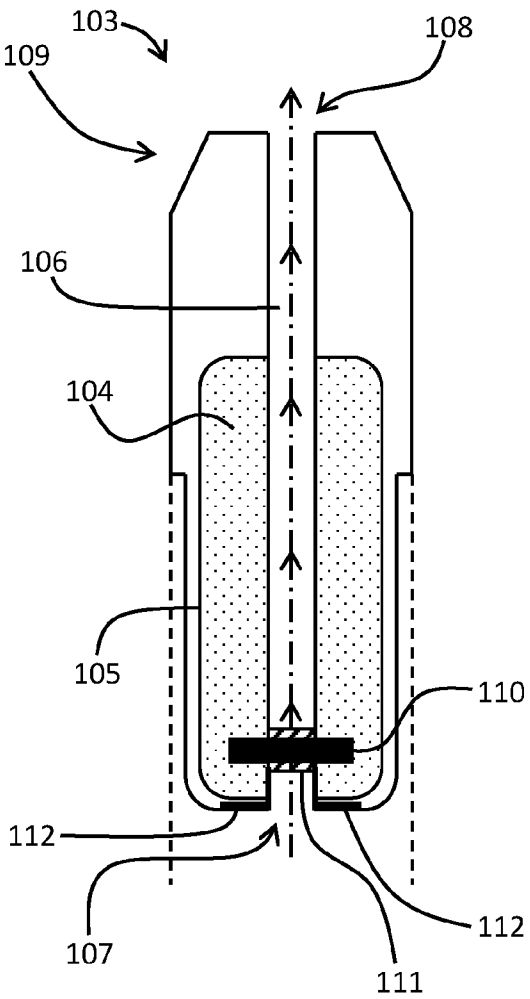
FIGS. 1A to 1C show a general smoking substitute system configured to provide an e-liquid to a user.
Figure 1B:
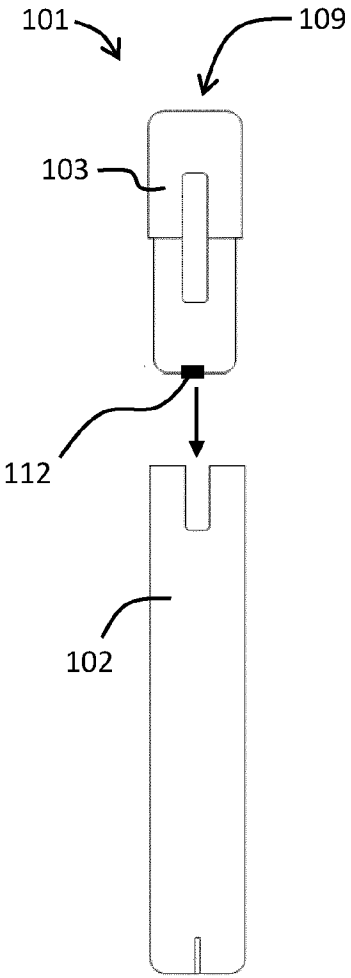
Figure 1A:
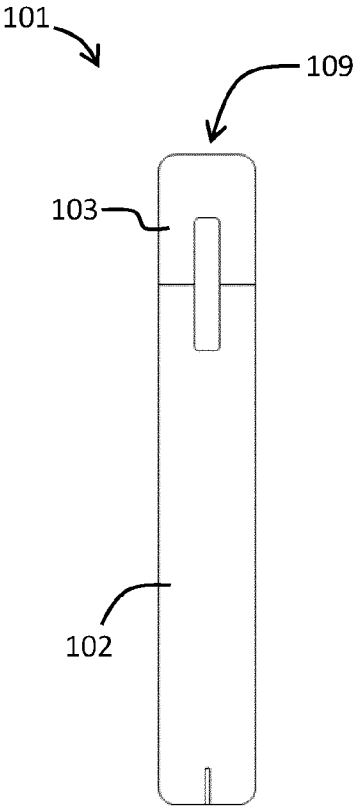

FIGS. 1A and 1B illustrate a smoking substitute system in the form of an e-cigarette system 101. The system 101 comprises an e-cigarette device defining a main body 102 of the system 101, and a smoking substitute apparatus in the form of an e-cigarette consumable (or "pod") 103. The smoking substitute apparatus is a smoking substitute apparatus. In the illustrated embodiment the consumable 103 (smoking substitute apparatus) is removable from the main body (e-cigarette device), so as to be a replaceable component of the system 101. In other words, the e-cigarette system 101 is a closed system.

As is apparent from FIGS. 1A and 1B, the consumable 103 is configured to engage the main body 102. FIG. 1A shows the main body 102 and the consumable 103 in an engaged state, whilst FIG. 1B shows the main body 102 and the consumable 103 in a disengaged state. When engaged, a portion of the consumable 103 is received in a cavity of the main body 102 and is retained in the engaged position by way of a snap-engagement mechanism. In other embodiments, the main body 102 and consumable 103 may be engaged by screwing one into (or onto) the other, through a bayonet fitting, or by way of an interference fit.

The system 101 is configured to vaporize an aerosol-former, which in the illustrated embodiment, is in the form of a nicotine-based e-liquid 104. The e-liquid 104 comprises nicotine and a base liquid including propylene glycol and/or vegetable glycerin. In the present embodiment, the e-liquid 104 is flavorless (and does not include any added flavorant). That is, if the e-liquid 104 were to be inhaled (i.e., in aerosol form) by a user, it would not have a particularly perceptible flavor or taste.

As is more apparent from FIG. 1C, this e-liquid 104 is stored within a reservoir in the form of a tank 105 that forms part of the consumable 103. In the illustrated embodiment, the consumable 103 is a "single-use" consumable 103. That is, upon exhausting the e-liquid 104 in the tank 105, the intention is that the user disposes of the entire consumable 103. In other embodiments, the e-liquid (i.e., aerosol former) may be the only part of the system that is truly "single-use". That is, the tank may be refillable with e-liquid or the e-liquid may be stored in a non-consumable component of the system. For example, the e-liquid may be stored in a tank located in the main body or stored in another component that is itself not single-use (e.g., a refillable cartomizer).

The tank 105 surrounds, and thus defines a portion of, a passage 106 that extends between an inlet 107 and an outlet 108 at opposing ends of the consumable 103. In this respect, the passage comprises an upstream end at the end of the consumable 103 that engages with the main body 102, and a downstream end at an opposing end of the consumable 103 that comprises a mouthpiece 109 of the system 101. When the consumable 103 is engaged with the main body 102, a user can inhale (i.e., take a puff) via the mouthpiece 109 so as to draw air through the passage 106, and so as to form an airflow (indicated by arrows) in a direction from the inlet 107 to the outlet 108 of the passage 106. Although not illustrated, the passage 106 may be partially defined by a tube (e.g., a metal tube) extending through the consumable 103. The passage 106 is in fluid communication with a gap defined between the consumable 103 and the main body 102 (when engaged) such that air outside of the system 101 is drawn into the passage 106 (during an inhale).

The smoking substitute system 101 is configured to vaporize the e-liquid 104 for inhalation by a user. To provide this, the consumable 103 comprises a heater having of a porous wick 110 and a resistive heating element in the form of a heating filament 111 that is helically wound around a portion of the porous wick 110. The porous wick 110 extends across the passage 106 (i.e., transverse to a longitudinal axis of the passage 106) and opposing ends of the wick 110 extend into the tank 105 (so as to be submerged in the e-liquid 104). In this way, e-liquid 104 contained in the tank 105 is conveyed from the opposing ends of the porous wick 110 to a central portion of the porous wick 110 so as to be exposed to the airflow in the passage 106 (i.e., caused by a user inhaling).

The helical filament 111 is wound about this exposed central portion of the porous wick 110 and is electrically connected to an electrical interface in the form of electrical contacts 112 mounted at the end of the consumable that is proximate the main body 102 (when engaged). When the consumable 103 is engaged with the main body 102, the electrical contacts 112 contact corresponding electrical contacts (not shown) of the main body 102. The main body electrical contacts are electrically connected to a power source (not shown) of the main body 102, such that (in the engaged position) the filament 111 is electrically connected to the power source. In this way, power can be supplied by the main body 102 to the filament 111 in order to heat the filament 111. This heat is transferred from the filament 111 to the porous wick 110 which causes e-liquid 104 conveyed by the porous wick 110 to increase in temperature to a point at which it vaporizes. The vaporized e-liquid becomes entrained in the airflow and, between the vaporization point at the filament 111 and the outlet 108 of the passage 106, condenses to form an aerosol. This aerosol is then inhaled, via the mouthpiece 109, by a user of the system 101.

The power source of the main body 102 may be in the form of a battery (e.g., a rechargeable battery). The main body 102 may comprise a connector in the form of, e.g., a USB port for recharging this battery. The main body 102 may also comprise a controller that controls the supply of power from the power source to the main body electrical contacts (and thus to the filament 111). That, is the controller may be configured to control a voltage applied across the main body electrical contacts, and thus the voltage applied across the filament 111. In this way, the filament 111 may only be heated under certain conditions (e.g., during a puff and/or only when the system is in an active state). In this respect, the main body 102 may include a puff sensor (not shown) that is configured to detect a puff (i.e., inhalation). The puff sensor may be operatively connected to the controller so as to be able to provide a signal, to the controller, which is indicative of a puff state (i.e., puffing or not puffing). The puff sensor may, for example, be in the form of a pressure sensor or an acoustic sensor.

Although not shown, the main body 102 and consumable 103 may comprise a further interface which may, for example, be in the form of an RFID reader, a barcode or QR code reader. This interface may be able to identify a characteristic (e.g., a type) of a consumable 103 engaged with the main body 102. In this respect, the consumable 103 may include any one or more of an RFID chip, a barcode or QR code, or memory within which is an identifier and which can be interrogated via the interface.

Exemplary Granulation Method

In an example method of the present disclosure, a carrier HPMC is added to a mixing vessel and sealed before supercool menthol flavorant and the liquid binder are added. The carrier is stirred ready for the addition of the liquid components of the granulation process.

The supercool menthol flavorant component is then added directly on to the carrier HPMC. The addition of the supercool menthol flavor is done dropwise to the stirring mixture to ensure even distribution and loading of the flavor onto the carrier mix.

The pullulan liquid binder is in the form of a 20% stock solution. The stock solution is produced by dissolving the appropriate amount of pullulan liquid binder in the appropriate amount of water. Once fully dissolved, the pullulan liquid binder is then added dropwise to the stirring carrier HPMC and supercool menthol flavorant to form granules. The pullulan liquid binder protects the flavor from being evaporated from the resulting granules. The granulation process is judged visually, either by eye or automated video monitoring equipment, to ensure the correct amount of pullulan liquid binder is utilized and that there is no over granulation or grouping of granules.

Upon addition of each component to the granule mixture, the granules are emptied onto a small tray and separated. The individual granules are then allowed to dry for 24 hrs inside of a fume hood. Shorter drying times may be advantageous in keeping the flavor on the granules and prevent over evaporation.

Exemplary Pouching of the Granules

Figure 3:
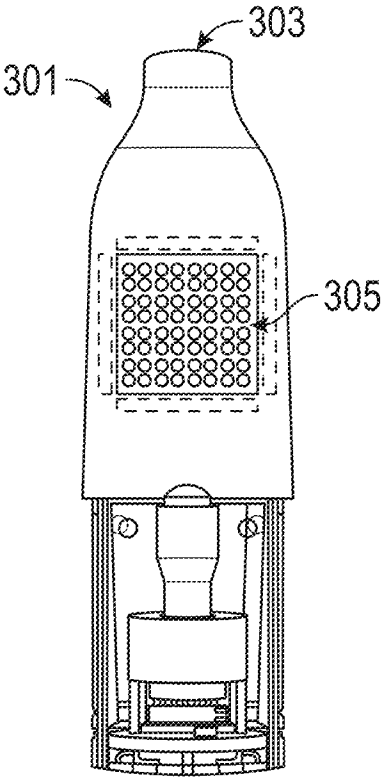
FIG. 3 is a front cutaway view of a smoking substitute apparatus having the pouch of FIG. 2 that has been trimmed to size and positioned in the airflow channel upstream of the mouth end.
Figure 2:
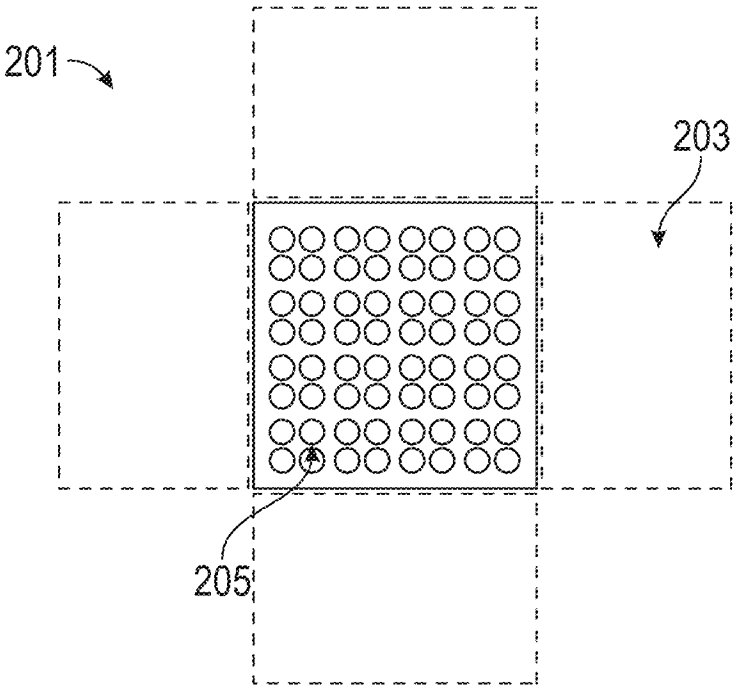
FIG. 2 is a schematic of a single pouch filled with granules or a granulated composition before the excess non-woven fabric has been trimmed.

FIG. 2 illustrates a non-woven fabric pouch 201 according to the present disclosure. When dry, the granules or granulation mixture may be sealed inside a non-woven fabric pouch. The pouch is sized at 15 mm by 15 mm for filling. A 10 mm allowance 203 was placed on each side to allow for effective sealing of the pouch. The pouch is filled with approximately 500 mg of granulated composition or granules 205. The pouch is sealed and the 10 mm allowance is trimmed down to size to provide a pouch having a 5 $mm^2$ surface that is sized to fill the cavity in an airflow channel at the top of the smoking substitute apparatus. With reference to FIG. 3, sealing the granules inside a nonwoven fabric pouch 305 in this way safely conceals the granulated composition or granules in the tip of the smoking substitute apparatus 301 and causes the airflow through the channel to pass over and/or through the granules thereby extracting and transferring the flavorant to the user when they inhale through the mouth end 303.

The sealing of the pouch may be achieved by ultrasonic sealing, hydroentanglement or needle punching, thereby avoiding the need to incorporate a plastic sealant material such as polypropylene into the pouch.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. A smoking substitute apparatus comprising:

a non-woven fabric pouch; and a flavorant delivery article having a granulated composition compriisng a flavorant, a binder and a carrier, the granulated composition being in the non-woven fabric pouch, wherein the flavorant delivery article is positioned in an airflow channel upstream from a mouth end such that, when in use, flavorant is transferred to a flow through the airflow channel.

2. A smoking substitute apparatus according to claim 1, wherein the granulated composition comprises granules and each of the granules has a substantially uniform composition throughout.

3. A smoking substitute apparatus according to claim 1 having a reservoir that contains a flavorless e-liquid.

4. A smoking substitute apparatus according to claim 1 wherein the mean average particle size of the granulated composition or granule size of the granules is up to 5 mm.

5. A smoking substitute apparatus according to claim 1 wherein the granulated composition or each of the granules comprises a disintegrant.

6. A smoking substitute apparatus according to claim 1 wherein the granulated composition or granules comprise up to 20 wt % of the flavorant.

7. A smoking substitute apparatus according to claim 1 wherein the smoking substitute apparatus is an aerosol delivery apparatus.

8. A method of manufacturing a flavorant delivery article for a smoking substitute apparatus, comprising a step of granulating a carrier, a flavorant and a binder to form granules, wherein each of the granules has a substantially uniform composition throughout, and further comprising sealing the granules in a non-woven fabric pouch.

9. Use of a flavorant delivery article in smoking substitute apparatus, wherein the flavorant delivery article is as defined in claim 1.

10. A smoking substitute aqpparatus according to claim 1 wherein the flavorant is selected from the group consisting of menthol, liquorice, chocolate, fruit flavour, vanilla, spice, tobacco flavour, supercool menthol, green apple and blueberry mint.

11. A smoking substitute aqpparatus according to claim 1 wherein the binder is selected from the gorup consisting of a wax, a starch, a polymer, a latex, and a plastic.

12. A smoking substitute aqpparatus according to claim 1 wherein the carrier is selected from the group consisting of one or more of hydroxyporpyl methylcellulose (HPMC), rich starch, wheat starch, potato starch, microcrystalline cellulose (MCC), bamboo fibres, wheat fibres and oat fibres.

13. A smoking substitute aqpparatus according to claim 1 wherein the granulated composition comprises granules, and wherein the flavorant is only contained within the granulated composition or granules of the smoking substitute apparatus.

14. A smoking substitute aqpparatus according to claim 1 wherein the smoking substitute apparatus can be opened or disassembled to insert or remove the flavorant delivery article; or wherein the smoking substitute apparatus comprises an opening adapted to receive the flavorant delivery article.

* * * * *